US007683763B2

(12) United States Patent
Nelson

(10) Patent No.: US 7,683,763 B2
(45) Date of Patent: Mar. 23, 2010

(54) NIGHT LIGHT WAKE UP INDICATOR

(76) Inventor: Adam Nelson, 630 Lakehill Way, Alpharetta, GA (US) 30022

( * ) Notice: Subject to any disclaimer, the term of this patent is extended or adjusted under 35 U.S.C. 154(b) by 291 days.

(21) Appl. No.: 11/859,806

(22) Filed: Sep. 24, 2007

(65) Prior Publication Data

US 2009/0079561 A1 Mar. 26, 2009

(51) Int. Cl.
*G08B 1/00* (2006.01)

(52) U.S. Cl. ..... 340/309.16; 368/285

(58) Field of Classification Search ..... 340/309.16, 340/309.4, 309.5, 309.7; 368/285
See application file for complete search history.

(56) References Cited

U.S. PATENT DOCUMENTS 6,822,556 B2 * 11/2004 Burns et al. ..... 368/223
2005/0174777 A1 * 8/2005 Cooper et al. ..... 362/276
2006/0052172 A1 * 3/2006 Stephen et al. ..... 472/135
2007/0279234 A1 * 12/2007 Walsh ..... 340/309.16
2008/0239882 A1 * 10/2008 Fujii ..... 368/109
2009/0016168 A1 * 1/2009 Smith ..... 368/10

* cited by examiner

*Primary Examiner*—John A Tweel, Jr.
(74) *Attorney, Agent, or Firm*—Smith Frohwein Tempel Greenlee Blaha, LLC; Gregory Scott Smith

(57) ABSTRACT

A night light that transitions between at least two states to provide a visual indication to a child as to whether it is time for the child to get out of bed or that the child should stay in bed. The night light shows an illuminated sun to indicate that the child can get out of bed. The night light shows an illuminated moon with a border of Z's to indicate that the child should stay in bed. The transitions between modes are based on information entered into a user interface, the current time, and/or the actuation of buttons on the device.

15 Claims, 6 Drawing Sheets

NIGHT LIGHT WAKE UP INDICATOR

CROSS-REFERENCE TO RELATED APPLICATIONS

This application is related to United States Design Patent filed on the same day as this application, having a title of NIGHT LIGHT, assigned Ser. No. 29/295,215 and United States Design Patent filed on the same day as this application, having a title of NIGHT LIGHT, assigned Ser. No. 29/295,216 incorporated herein by reference.

BACKGROUND OF THE INVENTION

"Just 15 more minutes, that's all I ask, just 15 more minutes!" This is a common cry of an exhausted parent. It is often heard from a parent burying his or her head in a pillow as a sweet little face peers up at them from the side of the bed in the wee hours of the morning, and then requests some milk, a bowl of cereal, permission to watch "toons" or simply wanting to play. Or, for the younger child that has not yet figured out how to climb out of bed, the bed side visit is supplanted by a screaming voice from the child's room boldly requesting Mommy or Daddy to come.

To all parents of young children, sleep is quite sacred—and scarce. Anything that would help to foster quiet times for their children, especially in the 5:00 am to 9:00 am range is greatly appreciated. If you have ever tried to logically reason with a 2 to 5 year old that it is not time to wake up yet, I am sure that you found that your ability to break through that understanding barrier was quite limited. They clearly don't understand or appreciate the exasperated "Mommy needs just 15 more minutes of sleep" plea. Nor do they seem to understand the reasoning that it gets lighter earlier and stays light longer in the summer time than in the winter time. And the old line of "wait until the long arm is on the 12 and the little arm is on the 9" simply falls on deaf ears as your child stares at you, blinking like a frog in a hail storm. And on top of all of that, at 6:00 am it is really not easy to come up with a good, 2 to 5 year old level argument as to why they have to stay in bed and be quiet.

What is needed in the art is a technique to clearly deliver a message to a child that it is time to stay in bed and sleep. Preferably, it is desired that this message can be delivered to a child without a parent having to wake up, yell the message to the room down the hall or up the stairs, and especially prior to the parent having to go to the child's room or waking up with the child standing beside their bed, tugging on the parent's pajamas.

One thing that you learn quite quickly, especially if you sit and watch BABY FIRST TV, SESAME STREET or THE MICKEY MOUSE CLUBHOUSE shows, kids are smart. However, the key to tapping into this smartness is all in the delivery of the message. What really works are simple and clear statements that are repeated or constant and that are delivered along with animation.

What is needed in the art is a technique to deliver a message to a child it is time to stay in bed and sleep in such a manner that is simple and clear, repeatable and is delivered along with animation.

Another important aspect of a child is anticipation that something good is on the way. For instance, a parent learns early on in child rearing that you get more peas down a child if you say "eat your peas and you can have some ice cream for dessert". Entering the bathtub is always easier if a floating, squeaking or spraying toy is promised. Parents also learn quickly that simply saying "play time is over lets go inside" never goes over as well as saying "play time will be over in 10 minutes to finish up what you are doing before we go inside". Thus, what is needed in the art is not only a technique to deliver a message that it is time to stay in bed, but also to create an anticipatory environment that will serve as an indicator to the child that it is time to wake up and get out of bed.

Somewhere along the road of life, we generally migrate from a desire to have a light on in our room when we go to sleep to preferring darkness. Although the timing and the reasoning behind this migration may vary, it is nonetheless well known that that majority of children prefer to have some light on in the room when being put to bed. The trueness of this tendency is illustrated by the market for night lights. Because most children already have a night light, it would be beneficial to combine the above-described needs in the art into a night light embodiment to kill two birds with one stone.

As is shown in the following description, the present invention meets these needs in the art in a novel manner.

BRIEF SUMMARY OF THE INVENTION

Embodiments of the present invention are directed towards a night light that provides an indicator to a child as to whether or not it is time for the child to wake up or, the child needs to stay in bed. The various embodiments operate as a behavioral modification device to help instruct children as to the appropriate time to get out of bed. In one embodiment, the invention is implemented as a dual mode night light that transitions from a wake up state that displays an illuminated sun, to a stay in bed state that displays an illuminated moon. By observing the current state of the night light, the child is clearly instructed as to whether or not it is time to get out of bed.

One objective of at least some of the various embodiments of the present invention is to educate children to stay in bed until they are authorized or allowed to get out of bed. Some children between the ages of 3 and 5 years of age are just starting to grasp the concept of day and night and how it relates to regularly scheduled rest. Embodiments of the present invention can assist children with better differentiating the concept of nighttime and daytime and reinforce the benefits of appropriate sleep patterns. As such aspects of the present invention can be incorporated into embodiments that combine a traditional night-light and a built in timer that changes the visual display characteristics to reinforce a regular sleep pattern.

Having a bright light, even a regular nightlight, on in a child's room may inhibit teaching them that when it is dark, it is time for sleep and when it is light, its time to get up. Thus, one benefit is to educate children to associate light with the daytime activities, and darkness with nighttime and rest. Ideally, the night-light would be on a timer such that the light will be bright while they first go to sleep, and automatically dim after a set time. Embodiments of the present invention may implement this approach and, in addition, provide additional reinforcement that its time to rest by displaying an easily recognized display, such as a caricature of the moon. Children may easily and rapidly tend to associate the dim unobtrusive moon image with the knowledge that it is still bedtime and they should go back to sleep. In at least one embodiment of the present invention, the device will brighten and display a cheerful "Sun" caricature letting the child know that is time to wake up and that it is permissible to get out of bed and start the days activities. During the day, embodiments of the present invention may automatically shut off to eliminate any distractions and to conserve energy.

If a child is in the habit of waking up a certain time, they will tend to continue this regular pattern until it is reset.

Unfortunately, if the established pattern is to wake up too early, the result is that a child will become active on their own schedule which interferes with their own healthy sleep pattern and can be a disruptive influence to the entire household particularly Mom and Dad! It can be extremely difficult to modify this pattern without a visual cue that can be easily understood by even very young children. The various embodiments of the present invention may provide such a behavioral cue with its easily distinguished display of the Moon, meaning, "time to rest" and the Sun display meaning "time to get up!".

Many would agree that rest is a significantly important requirement for development and learning and a well-rested child is normally happier and better behaved than those that may be sleep deprived. To encourage the appropriate sleep pattern, an embodiment of the present invention can gradually be set to longer and longer sleep periods until the child is getting the full nights rest required.

Various features and aspects of the embodiments of the invention may include the following:

Ability to plug into a standard outlet (Capable of supporting international voltage which may require an adapter);

A digital timer with multiple settings;

A timer for activating the Moon image;

A dimmer functionality as a standard or optional feature;

A Moon image shut off;

A Sun image turn on;

A Sun image turn off

One embodiment of the invention includes a user interface that enables a user to program a current time, a wake up state transition time and a stay in bed state transition time. Once programmed, the night light of this embodiment constantly monitors the current time until a transition time is reached. Once a transition time is reached, the night light transitions into the appropriate state.

Other optional, but potentially novel features and aspects of the present invention include a go-to-sleep button to force a transition to the stay in bed state and a take-a-nap button that forces a transition to the stay in bed state for a particular period of time.

The animated appearance of the device can be achieved using a variety of techniques. One technique is to use to bulbs of differing colors, one yellow for the wake up state and one blue for stay in bed state.

DETAILED DESCRIPTION OF THE INVENTION

Various embodiments of the present invention, as well as features and aspects thereof, are directed towards a night light device that provides a clear indicator to a child regarding whether it is time to wake up or to stay in bed. In general, an embodiment of the present invention is a night light that can be programmed to toggle between two states: a wake up time state and a stay in bed state. For instance, such an embodiment can be programmed to enter the wake up state at 8:30 am and to transition to the stay in bed state at 8:00 pm. In this embodiment, if a child wakes up, the child can look at the night light to receive instructions regarding whether the child can get out of bed (wake up state is on) or if the child needs to stay in bed (stay in bed mode). Thus, if a child wakes up at 8:00 am, the child would see that the above-described example would instruct the child to stay in bed. However, if the child wakes up after 8:30 am, the child would be able to observe that for this example, he or she can get out of bed. Advantageously, this embodiment, as well as other embodiments, features and aspects described herein, operate as a clear, simple, constant message to a child regarding whether the child can wake up or if he or she should stay in bed. Further, the device can incorporate animation to further assist in the delivery of a clear message.

Figure 1A:
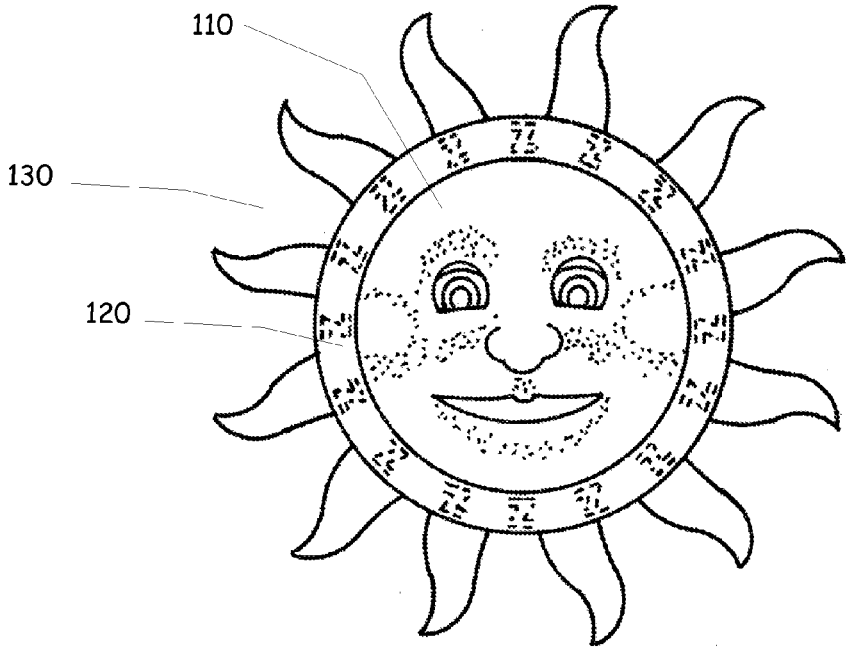
FIG. 1A is a conceptual diagram of time to wake up state of one embodiment of the present invention.
Figure 1B:
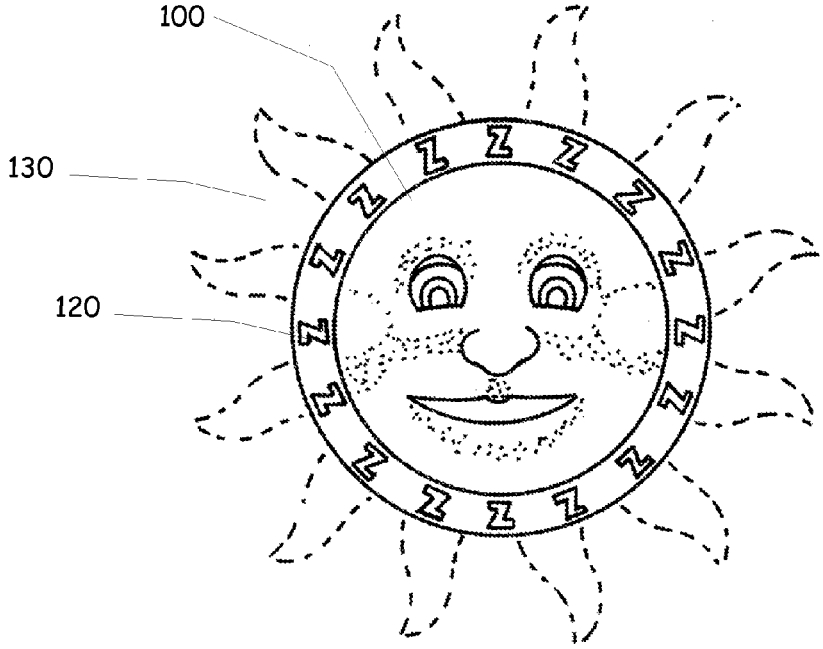
FIG. 1B is a conceptual diagram of a stay in bed state of one embodiment of the present invention.

FIGS. 1A and 1B are conceptual diagrams of one embodiment of the present invention. FIG. 1A is an animated depiction of the wake up state and FIG. 1B is an animated depiction of the stay in bed state. More specifically, FIG. 1A depicts the wake up state by showing a smiling face on the sun. FIG. 1B depicts the stay in bed state by showing a smiling face on the moon.

In one embodiment of the present invention, a single face on a night light can be used to provide both state indications. In the illustrated embodiment, the animation of the night light includes a facial region 110, a border region 120 and a fringe region 130 showing flames of the sun. In the illustrated embodiment, the border region 120 and the fringe region 130 are shown to be different between the wake up state of FIG. 1A and the stay in bed state of FIG. 1B. In the wake up state of FIG. 1A, the fringe area 130 (the beams of the sun) are prominent while the border area 120 containing Z's to indicate sleep (cutting logs) is diminished. In the stay in bed state of FIG. 1B, the fringe area 130 is diminished while the border area 120 is prominent. In both states, the face remains constant.

The prominent and diminished effect on the various regions of the embodiment illustrated in FIGS. 1A and 1B can be accomplished in a variety of manners. For instance, in one embodiment of the present invention, the use of lighting can be used to create the desired effect. In the wake up state, lights can be turned on to illuminate the beams of the sun region 130 and the face region 110 while the border region 120 remains darkened. Upon entering the stay in bed state, the border region 120 and the face region 110 can be illuminated and the beams of the sun region 130 can remain darkened.

In another embodiment, the lighting scheme described above can be utilized with the addition of using colored bulbs, LED or other lamp devices. For instance, in the wake up state, yellowish lighting can be used to illuminate the beams of the sun region 130 and the face region 110. When entering the stay in bed state, the yellow lighting can be turned off and a bluish lighting can be used to illuminate the border region 110 and the face region 120. Advantageously, this embodiment of the invention gives the appearance of the sun being illuminated during the wake up state and the moon being illuminated during the stay in bed state. Further, the facial region 110 can be constructed of a translucent material so as to create a glowing effect of the face in the various modes. Thus, in the wake up state, the face will glow in a yellowish color to resemble the sun, and in the stay in bed state, the face will glow in a bluish color to resemble the moon.

In another embodiment, lighting can be used to illuminate the features applicable to the wake up mode but, phosphorescent material or other material that exhibits phosphorescence characteristics can be used to illuminate the stay in bed state features. Thus, entering the stay in bed state simply would involve turning off the lighting. Advantageously, this embodiment requires less energy. If the phosphorescence material maintains a glow through the night, then an early riser would see the moon and know it is still time to stay in bed. Alternatively, the child can be instructed that a glowing moon or no light would indicate that the child is to stay in bed and wait for the wake up state to be entered.

Other techniques could also be used to provide the prominent and diminished effect for the various regions. For instance, in one embodiment the border region 120 could include a sliding face that would operate to slide over or cover the Z's while the wake up state is active and to reveal the Z's when the stay in bed state is active. In another embodiment, the sun beams could be mechanically retracted behind the face region 110 while the stay in bed state is active and then extended from the face region 110 when the wake up state is active.

In another embodiment, varied colors can be attained by shining a light through different colored material. Thus, the border region 120 could include Z's that are fabricated from a clear bluish color material and the beams of the sun region 130 could be fabricated from a material that is clear and yellowish in color. The two regions could be illuminated by either directing the lighting with reflectors, or strategically located lamps, or by the sliding cover and retractable beams technique described above or some other technique.

Figure 2:
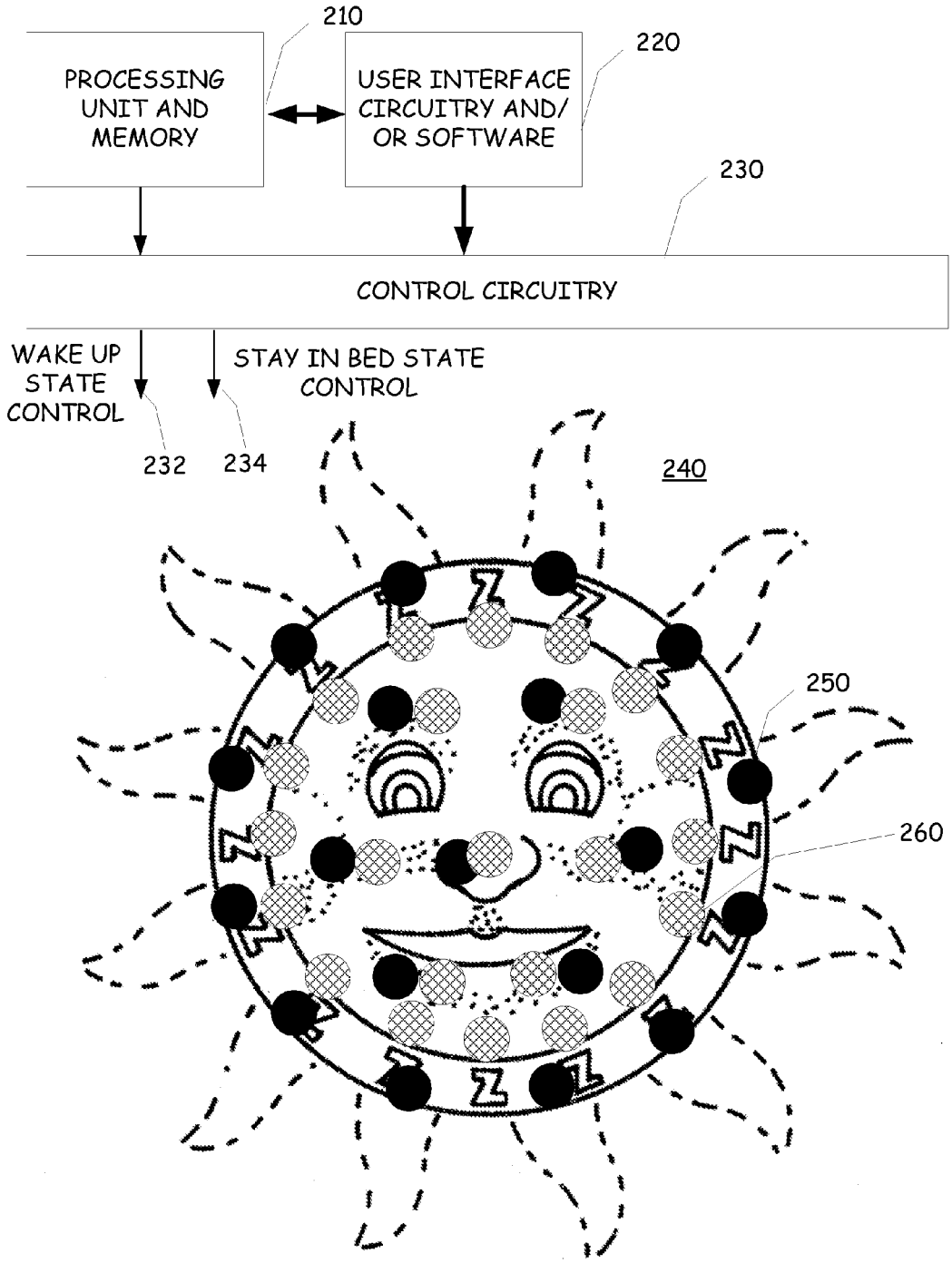
FIG. 2 is a block diagram of one design for implementing an exemplary embodiment of the present invention.

FIG. 2 is a block diagram of one design for implementing an exemplary embodiment of the present invention. The illustrated embodiment shows a CPU 210 that is communicatively attached to user interface circuitry 220 and control circuitry 230. The user interface circuitry 220 also interfaces to the control circuitry 230. The control circuitry interfaces to the various portions of the night light display 240, including a first set of lamps 250 and a second set of lamps 260.

More specifically, the user interface 220 may be constructed in a variety of manners and at varying levels of complexity. In the most simplistic form, the user interface may resemble a mechanical timer interface, similar to a Christmas tree light timer, that allows the user to identify the time on and time off points—or as in the various embodiments of the invention, the time to switch between states. In such an embodiment, it is also anticipated that the processing unit could be eliminated and the entire night light controlled by the mechanical device. Similarly, rather than a processor, a simple comparator that can compare a current time with a threshold time, or two signals corresponding with the current time and a threshold time can be employed in various embodiments.

The user interface could also include a standard alarm clock programming type interface or even include a more advanced interface, even including a USB port interface to a computer or a wireless interface to a computer. Regardless of the type and complexity of the interface, the user interface 220 needs to provide the ability for a user to enter times for conducting state changes from the wake up state to the stay in bed state, and typically, the ability to enter a current time. However, it should be understood that some embodiments may be able to detect and receive the current time over the air. As a non-limiting example, a user may program the wake up state to be come active at 8:30 am and the stay in bed state to become active at 8:00 pm.

The processing unit includes a timer chip or software functionality that keeps track of the current time and compares the current time to the programmed state change times. When the current time coincides with a state change time, the processing unit interfaces to the control circuitry to cause a state change. For instance, in the illustrated embodiment, the wake state lamps 250 are shown as solid dots and the stay in bed state lamps 260 are shown as hashed dots. When the processing unit 210 determines that the current time is 8:30 am (the wake up state triggering time as provided in the example above), the processing unit 210 sends signals to the control circuitry 230 to cause the wake up state control signal to be triggered, thereby illuminating the wake state lamps 250. When the processing unit 210 determines that the current time is 8:00 pm, the processing unit 210 send signals to the control circuitry 230 to cause the stay in bed state control signal to be triggered, thereby illuminating the stay in bed state lamps 260.

In the illustrated embodiment, which is provided only as a non-limiting example, the wake up state lights 250 are arranged and correspond to the beams of the sun and the stay in bed state lights 260 are arranged and correspond to the Z's. Shielding can be provided, with or without reflectors, to direct the lights toward the intended features of the night light fixture. In addition, the face region of the night light can include an array of both types of lights without requiring the shielding. It will also be appreciated that rather than using the lamps 250 and 260 to illuminate the various aspects of the night light fixture, the various aspects could be constructed of LED type material. Thus, the sun beam LEDs would be illuminated in the wake up state and the Z LEDs would be illuminated in the stay in bed state.

Figure 3:
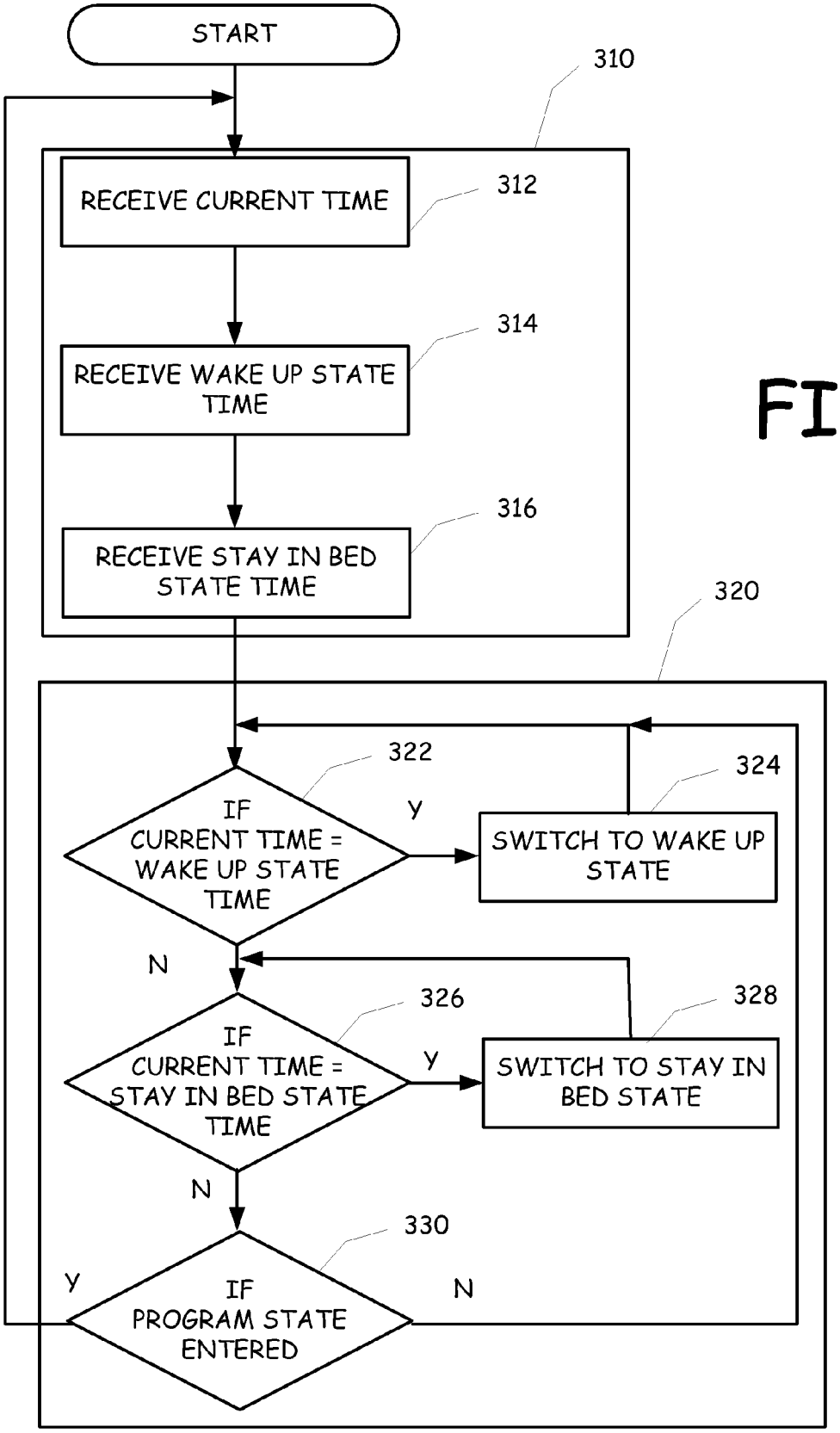
FIG. 3 is a flow diagram illustrating the operation of an exemplary embodiment of the present invention.

FIG. 3 is a flow diagram illustrating the operation of an exemplary embodiment of the present invention. In the illustrated embodiment, the process begins when a programming mode 310 is entered. Once entered, a user enters, or the processing unit receives a current time 312. Next a wake up state time is programmed 314 and then a stay in bed state time is programmed 316. Once all of the required parameters are either programmed or received, an operational state 320 is entered. In the operational state, the current time is compared to the wake up state time 322. If the current time is equal to the wake up state time, then the night light is switched to the wake up state 324. Otherwise, the current time is compared to the stay in bed state time 326. If the current time is equal to the stay in bed state time, then the night light is switched to the stay in bed state 328. Otherwise, the user interface is examined to determine if the user is selecting to enable the programming mode 330. If not, processing continues by comparing the current time to the wake up state time 322 and so on. However, if the user has selected to enable the programming mode, then the programming mode 310 is entered again.

In an alternative embodiment, or as an additional feature to another described embodiment, the user interface may include a go-to-sleep button. The purpose of the go-to-sleep button is to force a transition from the wake up state to the stay in bed state. Thus, when a parent puts a child to bed, the parent can actuate the go-to-sleep button to place the night light into the stay in bed state. At the programmed time, the night light will then transition to the wake up state.

In another embodiment, or as an additional feature to another described embodiment, the user interface may include a take-a-nap button. The purpose of the take a nap button is to force a transition from the wake up state to the stay in bed state. However, when the take-a-nap button is actuated, a timer is initiated that will automatically cause a transition back to the wake up state after a predetermined, programmed or selected period of time. For instance, a default may be a 30 minute nap. However, some embodiments may allow the user to program a nap time. In still other embodiments, the nap time may be selected based on a user interface actuation. For instance, each actuation of the take-a-nap button may increment the counter by 30 minutes. Thus, the parent could actuate the take-a-nap button three times to request an hour and a half long nap.

In yet another embodiment, the night light may include more than two states. For instance, the night light may include the wake up state, the stay in bed state and a take a nap state. Each of the states may cause a different animation and lighting scenario.

In another embodiment, or as an additional feature to another described, when the stay in bed state or the take a nap state is entered, soothing music or sounds can be played for a given period of time. In addition, the entrance to the wake up state may also serve as an alarm clock to awaken the sleeping child. For instance, the alarm can sound upon entrance into the wake up state or, after a delay period after entering the wake up state.

It will be appreciated that the present invention could also be implemented in a software program running on a computer or computing device with a display, such as an LCD display, RGB monitor, or the like. Advantageously, this embodiment of the present invention provides greater flexibility in the various looks of the night light device and may even provide for user selectable skins or looks and feel. For instance, moving animation as well as other features could also be incorporated into such an embodiment.

Similarly, the night light could be constructed as an LCD display driven by a processing unit. The LCD display could also serve as the user interface for programming the device. The use of an LCD display also provides greater flexibility in the look and feel of the night light and could enable a user to select the look and feel desired.

In another embodiment, or as an additional feature to another described embodiment, the night light may include a photo-sensor to detect when it is light and dark. The photo-sensor could be used as a condition on the state changes. For instance, the night light could be set to enter wake up mode when the room is detected to contain sufficient light. Likewise, when the room becomes dark, the stay in bed state could be invoked based on the photo-sensor reading.

Figure 4A:
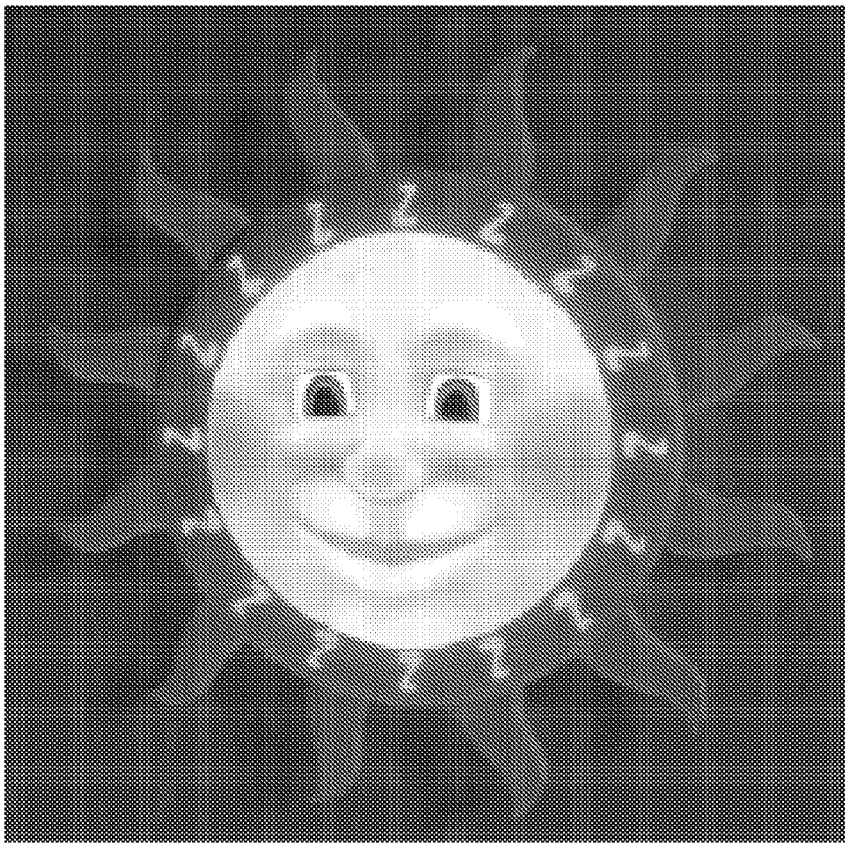
FIG. 4A is a depiction of an embodiment of the present invention in the stay in bed state.
Figure 4B:
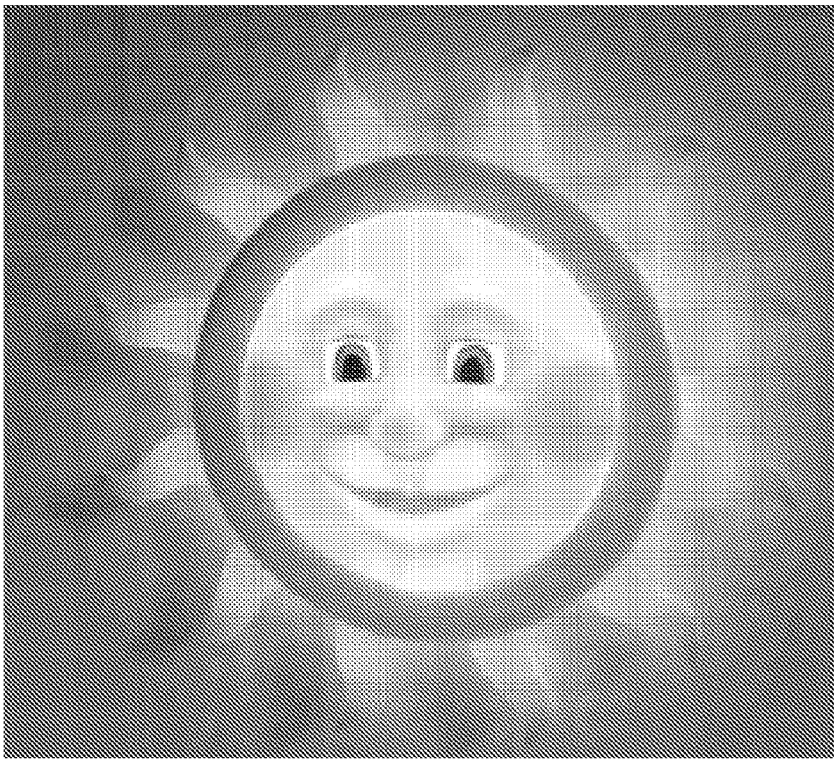
FIG. 4B is a depiction of an embodiment of the present invention in the wake up state.

FIG. 4A is a depiction of an embodiment of the present invention in the stay in bed state. In the illustrated embodiment, the certain features are highlighted to show a caricature of the Moon lit up in a blue color. FIG. 4B is a depiction of an embodiment of the present invention in the wake up state. In the illustrated embodiment, the certain features are highlighted to show a caricature of the Sun lit up in a yellowish orange color. Thus, this embodiment of the invention operates to show a lit Moon to encourage a child to stay in bed by identifying an element that is common with the nighttime—the Moon. Further, this embodiment provides a clear signal to a child that it is time to rise by identifying an element that is common with the daytime—the Sun.

Figure 5A:
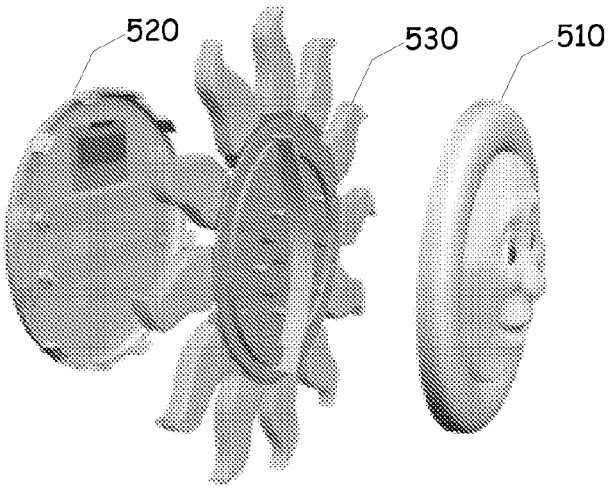
FIG. 5A is a depiction of an assembly of one embodiment of the present invention.
Figure 5C:
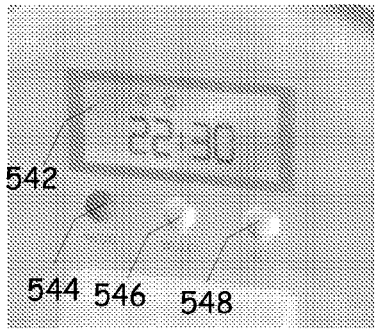
FIG. 5C is an enlarged view of the user interface for the assembly illustrated in FIG. 5A and FIG. 5B.
Figure 5B:
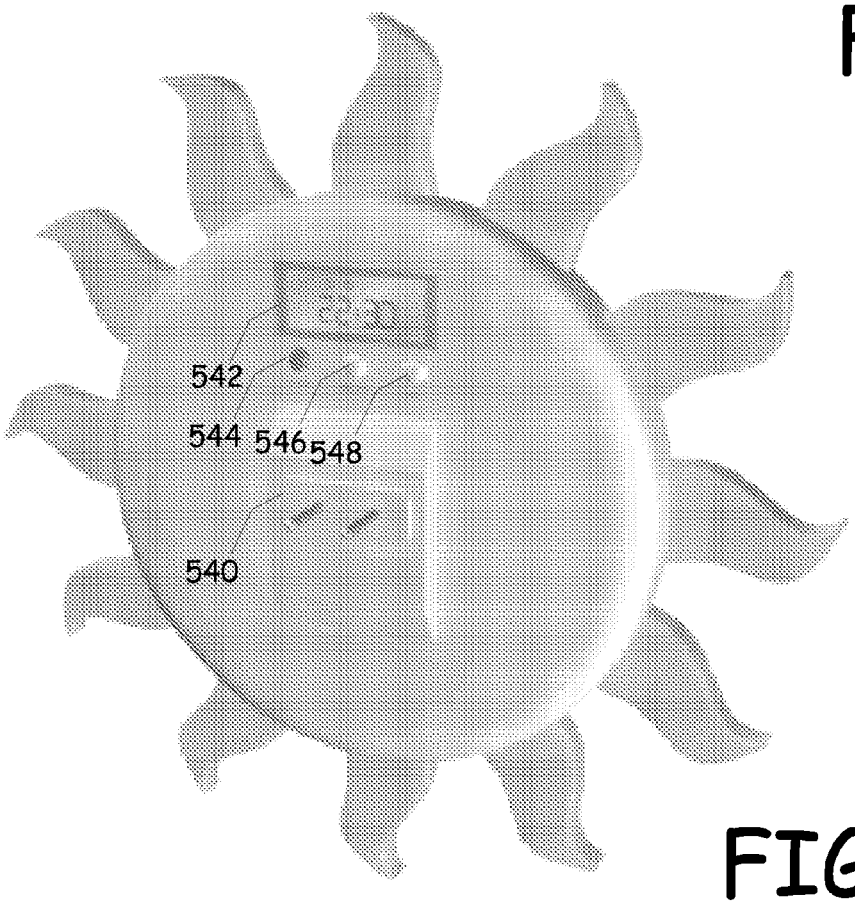
FIG. 5B is a rear view of the assembly illustrated in FIG. 5A.

FIG. 5A is a depiction of an assembly of one embodiment of the present invention. The assembly includes a face element 510, a base 520 and a light assembly 530. FIG. 5B is a rear view of the assembly illustrated in FIG. 5A. The back of the illustrated embodiment includes an electrical plug 540 that can be adapted to any of a variety of interfaces including US and European, a display 542 and mode change button 544 a select button 546 and a set button 548. The various buttons can be used to program the operation of this embodiment of the device by allowing the user, as non-limiting examples, to set the current time, set the trigger times for transitioning from one state to the next, set the transitioning time periods to go from a dim mode to a bright mode or an off mode, etc. FIG. 5C is an enlarged view of the user interface for the assembly illustrated in FIG. 5A and FIG. 5B.

Figure 6:
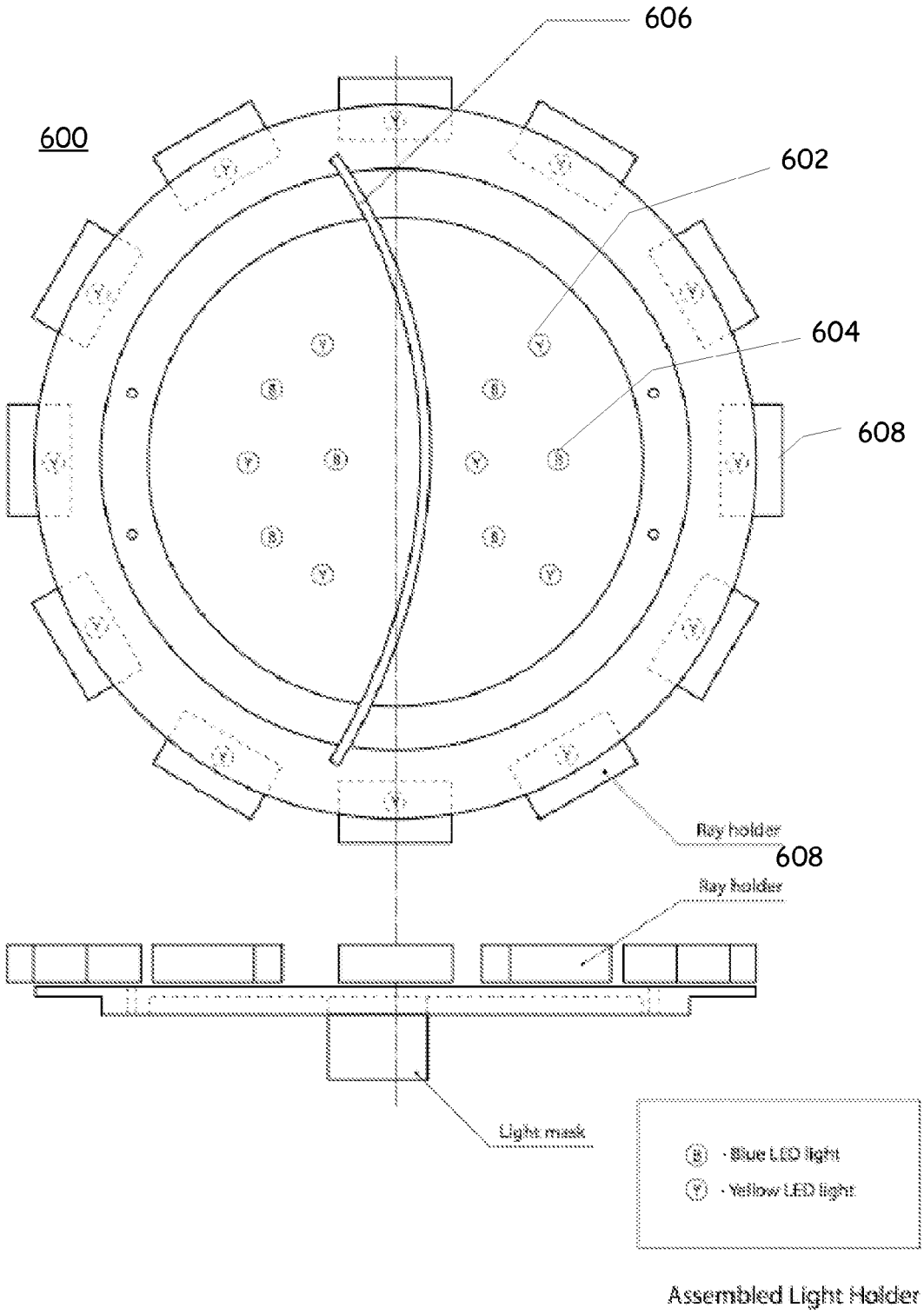
FIG. 6 is a depiction of an exemplary light holder for an embodiment of the present invention.

FIG. 6 is a depiction of an exemplary light holder for an embodiment of the present invention. The illustrated embodiment is shown with two types of light sources marked as "Y" for yellow (such as light 602) and "B" for blue (such as light 604). A light mask 606 is used to provide illumination control capabilities for the display. By having the light mask 606, the night light can be selectively illuminated. It will be appreciated and several light masks could be employed in a variety of configurations and, in some embodiments the light mask may be eliminated. Several holders for the Sun's rays 608 are located around the perimeter o the light assembly 600.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A night light and wake up indicator apparatus comprising:

a display device that consists only of a facial region, a border region surrounding the facial region, a fringe region surrounding the border region, and a plurality of light sources behind the display device configured such that lights of a first color are positioned to illuminate the fringe region and the facial region and, lights of a second color are positioned to illuminate the facial region and the border region;

a user interface for receiving a first state starting time and information related to a second state starting time;

an interface for receiving a current time;

a comparator for comparing a current time to the first state starting time and at least the information related to the second state starting time;

upon determining that the current time has reached the first state starting time, causing a display to enter a first state wherein the light sources of the first color are illuminated and the light sources of the second color are turned off, the first state providing an indication that it is time to wake up;

upon determining that conditions are met for entering a second state, causing the display to enter a second state wherein the light sources of the first color are turned off and the light sources of the second color are illuminated, the second state providing an indication that it is time to stay in bed;

wherein in the first state and the second state, the same facial region is illuminated but using light sources of different colors.

2. The night light and wake up indicator of claim 1, wherein the information related to a second state starting time is an actual time and being further configured to turn off all light sources, and further comprising a mask to direct the lighting.

3. The night light and wake up indicator of claim 1, wherein the information related to a second state starting time is an actuation signal of a go-to-sleep button and the conditions for entering a second state comprise the reception of the actuation signal.

4. The night light and wake up indicator of claim 1, wherein the information related to a second state starting time is an actual time and in addition, an actuation signal of a go-to-sleep button can be received which overrides the second state starting time.

5. The night light and wake up indicator of claim 1, wherein the display device is three dimensional and is configured as an animated depiction of the sun and the moon and the fringe region includes sun beams, the border region includes a plurality of Z's, the first color of light sources is a yellowish light source and the second color of light sources is a bluish light source, and causing the display to enter into a first state comprises illuminating the yellowish light source such that the sun beams and facial region are illuminated as an animated sun and causing the display to enter a second state comprises illuminating the bluish light source such that the Z's and the facial region are illuminated as an animated sun, wherein the same facial region is used to animate the sun and the moon, and further comprising a mask to control what features are illuminated by the light sources.

6. A night light and wake up indicator apparatus comprising:

a display device;

a user interface for receiving a first state starting time and information related to a second state starting time, and for receiving an actuation of a take-a-nap button;

an interface for receiving a current time;

a comparator for comparing a current time to the first state starting time and at least the information related to the second state starting time;

upon determining that the current time has reached the first state starting time, causing a display to enter a first state, the first state providing an indication that it is time to wake up;

upon determining that conditions are met for entering a second state, causing the display to enter a second state, the second state providing an indication that it is time to stay in bed; and upon receiving the actuation signal of the take-a-nap button, causing the display to enter the second state for a period of time, wherein the period of time is determined by how many times the take-a-nap button is pressed.

7. The night light and wake up indicator of claim 1, wherein the interface for receiving the current time is the user interface.

8. The night light and wake up indicator of claim 1, wherein the interface for receiving the current time is an over-the-air interface.

9. A night light and wake up indicator apparatus comprising:

a multi-state display consisting only of an animated face, a border around the animated face and a plurality of sun beams around the border, wherein a first state of the multi-state display device comprises illuminating the animated face and the sun beams with a first color of illumination and wherein a second state of the multi-state display device comprises illuminating the animated face and the border with a second color of illumination;

a user interface for receiving a first state starting time and information related to a second state starting time;

an interface for receiving a current time;

a comparator for comparing a current time to the first state starting time and at least the information related to the second state starting time;

upon determining that the current time has reached the first state starting time, causing the multi-state display device to enter the first state; and upon determining that conditions are met for entering the second state, causing the multi-state display device to enter the second state.

10. The night light and wake up indicator apparatus of claim 9, wherein the comparator is a processing unit.

11. The night light and wake up indicator apparatus of claim 10, wherein the information related to a second state starting time is a time entry.

12. The night light and wake up indicator apparatus of claim 10, wherein the information related to a second state starting time is an actuation signal generated upon actuation of a go-to-bed button and the conditions for entering the second state comprises the reception of the actuation signal.

13. The night light and wake up indicator of claim 12, further comprising a take-a-nap button which when actuated, generates a second actuation signal that is received by a processor, and the process is operative to cause the multi-state display device to enter the second state for a period of time.

14. The night light and wake up indicator of claim 13, wherein the period of time is determined by a value provided through the user interface.

15. The night light and wake up indicator of claim 13, wherein the period of time is determined based at least in part on the manner in which the take-a-nap button is actuated.

* * * * *